United States Patent [19]

Trinks et al.

[11] 4,108,072

[45] Aug. 22, 1978

[54] ARMOR-PIERCING PROJECTILE HAVING SPACED CORES

[75] Inventors: Walter Louis Adolf Trinks, Rhöndorf; Wolfgang Ferdinand Struth, Weil am Rhein, both of Fed. Rep. of Germany

[73] Assignee: Deutsch-Franzosisches Forschungsinstitut, St. Louis, France

[21] Appl. No.: 517,188

[22] Filed: Dec. 27, 1965

[30] Foreign Application Priority Data

Dec. 29, 1964 [DE] Fed. Rep. of Germany ..... 1428679

[51] Int. Cl.[2] ..... F42B 13/06

[52] U.S. Cl. ..... 102/52

[58] Field of Search ..... 102/52, 53, 56, 69, 102/91

[56] References Cited

U.S. PATENT DOCUMENTS

| | | | |
|---|---|---|---|
| 740,914 | 10/1903 | Platz | 102/52 |
| 1,089,161 | 3/1914 | Shore | 102/52 |
| 1,301,860 | 4/1919 | McKenna et al. | 102/52 |
| 2,343,344 | 3/1944 | Thompson | 102/52 |
| 2,724,334 | 11/1955 | Norton et al. | 102/52 |
| 3,203,349 | 8/1965 | Schonberg | 102/52 |
| 3,213,792 | 10/1965 | Grenander et al. | 102/52 |

*Primary Examiner*—Verlin R. Pendegrass

*Attorney, Agent, or Firm*—Haseltine, Lake & Waters

[57] ABSTRACT

An armor-piercing projectile having first and second armor-piercing cores supported in axially spaced relation with an intermediate layer filling the space between the cores constituted of a material having a substantially lower sound transmissability than that of the cores to prevent shock detonation of the second core upon impact of the first core with an armor plate.

12 Claims, 2 Drawing Figures

ARMOR-PIERCING PROJECTILE HAVING SPACED CORES

Figure 1:
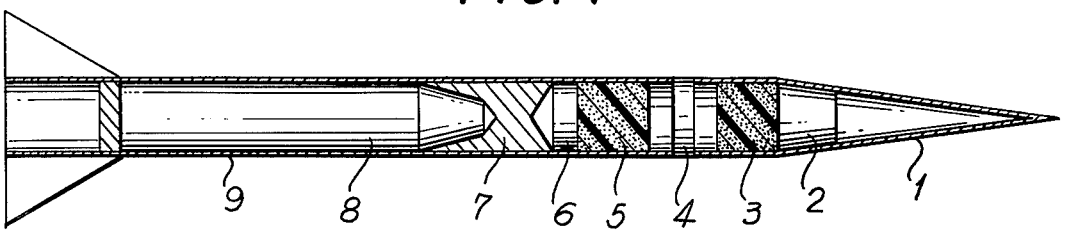

The present invention relates to projectiles or shells and preferably to drift-stabilized or fin-stabilized armor-piercing projectiles, for example, for anti-tank use. Such projectiles contain a hard-core which has great armor-piercing properties.

It is an object of the invention to provide a shell which not only has the good penetrating effects of previously known shell constructions against targets of single plate construction, but also is able to penetrate armor plate combinations having one or more front or supplemental armor plates in front of the main armor plate. This penetration of armor plate combinations cannot be achieved with the known types of hard-core shells. This is especially the case with so-called three-plate construction wherein the shell must undergo a comparatively great projectile path between the individual plates. When the known types of hard-core shells are used, the brittle hard-metal core breaks upon penetrating a comparatively thin front plate, especially when the angle of impact is small. If a second front armor plate is arranged ahead of the main armor plate, the hard-core is destroyed to such an extent that only a cloud of fragments strikes the main armor plate without any appreciable effect.

Consequently, the known hard-core armor-piercing projectiles (frequently provided with a cap in different known embodiments) are sometimes just about able to pierce light armor plate combinations having only one front armor plate, if the distance between the plates is comparatively small. Although the hard-core is broken after having pierced the front armor plate, the fragments are still sufficiently close to each other so that the density of energy is still sufficient to pierce a limited thickness of the subsequent main armor plate. However, the performance of such shells does not even begin to meet the requirements for piercing heavy armor plate combinations.

The essential requirement for anti-tank use against modern tanks, in addition to a good penetration of single plates even when the angles of impact are about 30°, is to pierce armor plate combinations having two and more front armor plates, even at small angles of impact, and this is not fulfilled by any of the known hard-core armor-piercing projectiles.

The present invention solves the above-described problem in that there is provided, in axially spaced relation in front of the hard-core, at least one additional armor-piercing projectile member, preferably a core of a tough heavy metal.

Such a construction produces the effect that the hard-core is substantially undamaged when striking the main armor plate and that it still has a sufficient piercing effect. The front cores, i.e. the cores disposed ahead of the main hard-core, pierce the successive front armor plates, so that the subsequent portion of the projectile member, i.e. the hard-core is able to pass unimpeded through the holes which are made by the front cores and which are of a size slightly larger in caliber or diameter than the hard-core. Consequently, the front shells are preferably made of tough metal which is compressed upon impact and produces sufficiently large holes in the front armor plates to allow unimpeded passage of the hard-core.

The effect of the armor-piercing shells according to the invention is promoted substantially if the shocks which are formed upon the impact of the individual front shells or front cores and which travel toward the rear of the shell at the velocity of sound, are largely isolated from the shock-sensitive hard-core. This object is advantageously attained by the provision of intermediate layers of suitable materials, principally between the hard-core and the last front shell or core. The intermediate layers prevent shock forces from reaching the hard-core and thereby prevent break-up thereof by shock detonation. Such materials preferably display an accoustic impedance (velocity of sound transfer through the materials $x$ the density thereof) which, compared to the material of the hard-core and the front core, shall be as small as possible, so that the shocks, travelling rearwards upon impact, are largely reflected at the various boundary or contact surfaces and only a small fraction of the shock energy is able to strike the hard-core, which is expediently further reduced by suitable streamline shaping of the transition surfaces between the hard-core and the intermediate layer. Such materials can be considered to have low accoustic impedance.

Since the intermediate layers contribute little or nothing to the actual penetration, their weight should be as small as possible. If they serve a structural supporting function in the projectile construction, they may be made of light-metal alloys, such as, for example, elektron or duralumin. (A shock wave impinging perpendicularly on a boundary surface is reflected, for example, to the extent of 80 to 85% in the case of elektron and tungsten carbide, and about 70% in the case of duralumin and tungsten carbide.) If the construction demands on the strength of the intermediate layers are less severe, it is possible to use synthetic resin bound hollow microspheres of quartz or glass of a diameter of 30 to 200 mu and a wall thickness of about 2 mu as the intermediate layer, which, in addition to being of low weight (about 0.5 g/cm$^3$) and of sufficient mechanical strength, have an excellent shock-absorbing effect. The resin may be an epoxy resin such as Araldite or the like. Foam construction of metals such as sintered aluminum or plastic materials may also be employed. Under certain circumstances, it is also possible to use heavier metals having a very low velocity of sound transmission and a correspondingly small accoustic impedance, such as, for example, lead and alloys thereof such as lead antimony, which then contribute to the penetration due to their mass. The selection of the materials for the intermediate layers and the proportion of the front shells to the total weight of the projectiles are determined, for a given gun, substantially by the exterior ballistic performance required and by the kind of armor to be pierced.

As known per se, the hard-core consists advantageously of a material, which is characterized by high values of hardness and density, preferably of a hard-metal or of a hard-metal alloy. Suitable materials for the hard-core may be a hard uranium alloy or tungsten carbide containing 8–13% cobalt.

The front core or cores are most suitably made of a metal which has a high toughness, strength and density. Since front armor plates are as a rule weaker than the main armor plates, the mass of the hard-core is advantageously many times that of each front core. The front cores may be a tough tungsten alloy or a tough uranium alloy or Kennertium W10 or Kennertium W2 made by Kennametal Inc.

The energy of the front cores must be sufficient to pierce all front armor plate combinations. On the other hand, the front cores and the hard-cores together must attain the performances required for penetration of a single-plate target. The masses of the front cores and of the hard-cores must be adjusted proportionately to meet the above-mentioned various requirements. In the case of a single plate, the front shells or cores contribute substantially to the depth of penetration; in addition, if the angle of impact is small, they create a favorable surface of attack for the hard-core, so that it is possible to select more pointed shapes of cores than are otherwise used for small angles, whose penetration resistance is smaller.

Figure 2:
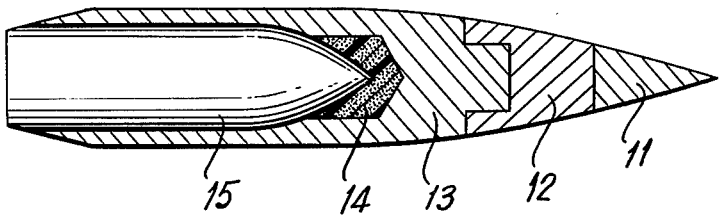

Two preferred embodiments of the invention will be described below, by way of example, with reference to the accompanying drawing, in which:

FIGS. 1 and 2 show axial sectional view of respective embodiments according to the invention.

FIG. 1 shows a fin-stabilized subcaliber hard-core projectile according to the invention, which contains three front shells or cores 2, 4, 6 of a tough heavy-metal alloy with a view to a great versatility of service. If the discharge or firing acceleration permits it, the first two intermediate layers 3, 5 consist of synthetic resin bound microspheres, while the third layer 7 consists, for example, of elektron. The extremely thin body 9 of the projectile carries the control or steering apparatus (not shown) and is constituted of high tempered steel. The hard-metal core 8 is disposed within the body 9 and is comparatively long, since a thin shape of the projectile and a high ballistic coefficient are particularly favorable as far as ballistic trajectories are concerned. The aerodynamic hood 1 is of no importance for the penetration.

The length of fin-stabilized projectiles such as that of FIG. 1 is not as limited as that of other types of projectiles and therefore permits the accommodation, for example, of three front cores and comparatively thick intermediate layers. In the case of drift-stabilized armor-piercing shells, on the other hand, a length of about 5 times the caliber must not be exceeded for reasons of stability.

FIG. 2 shows an embodiment of a drift-stabilized sub-caliber hard-core armor-piercing shell according to the invention, which produces at least the same effects in single plates as the most modern hard-core armor-piercing shells having the same weight and the same impact velocity, but which, additionally, also pierces multiple-plate targets, where the known projectiles are completely ineffective.

The shell of FIG. 2 comprises a front core 11 consisting, for example, of steel, and is adapted to pierce a comparatively thin, first front armor plate of a target. The second front core 12, made of tough heavy metal, is able to pierce a second, thicker front armor plate. The front core 12 has a maximum diameter which is at least equal to the caliber of the hard-core 15. If there is only a single, comparatively thick front armor plate on the target, the two front cores 11,12 act together. The subsequent core 13 is constituted preferably of elektron and protects the hard-core 15 against premature destruction. Its protective effect may be improved, if desired, by an additional intermediate layer 14 consisting, for example, of synthetic resin bound microspheres. Another essential factor is the shape or form of the boundary or contact surfaces between the cores and of the intermediate layers located in front of said cores. In this respect, said contact surfaces are shaped so that the effect of shocks, which still penetrate the intermediate layers only graze the core. More specifically, the leading edge of the hard-cores 15 and 8 are tapered in streamlined fashion to promote the passage of shock waves along their surfaces.

The hard-core armor-piercing projectiles according to the invention make it possible to pierce several front armor plates, even at very small angles of impact, without any appreciable destruction of the main core, so that the latter is still able to pierce the main and usually strongest armor plate. The penetration through a 3-plate target such as in modern tanks can now be carried out with solid impact projectiles and not only with hollow-charge projectiles, against which protective measures may be taken, which will have no effect in the case of such impact projectiles.

The expression "core" as used in the present Application is not necessarily limited to cores provided with a radial casing or jacket. The invention also includes projectiles, wherein the members referred to as cores in this application, extend at least partially over the entire cross-section of the projectile.

Although the front core or front cores according to the preferred embodiment are made of tough metal, it is possible to make modifications to the extent that the front cores, too, can be made of hard metal, in which case said front cores are so dimensioned that, upon piercing the front armor plates for which they are intended, they break into sufficiently small parts, so as to no longer obstruct the hard core.

What is claimed is:

1. An armor-piercing projectile comprising a hard-core having armor-piercing properties, means axially spaced a substantial distance in front of said core and capable of piercing an armor plate to form an opening therein of sufficient size to enable substantially unimpeded passage of said hard-core through said armor plate to a second armor plate to be pierced by said hard-core, and an intermediate layer filling the space between said hard-core and said means and constituted of a substance, having an accoustic impedance which is substantially different from the accoustic impedance of said core and said means.

2. A projectile as claimed in claim 1 wherein the accoustic impedance of said substance is lower than the accoustic impedance of said core and said means, said substance having shock absorbing properties.

3. A projectile as claimed in claim 2 wherein said means comprises at least one core spaced in front of the hard-core, each core being spaced from each adjacent core by said substance.

4. A projectile as claimed in claim 3 wherein said intermediate layer is constituted of a relatively light metal.

5. A projectile as claimed in claim 3 wherein said intermediate layer is constituted of lead or alloys thereof.

6. A projectile as claimed in claim 3 wherein said intermediate layer is constituted of a metallic foam.

7. A projectile as claimed in claim 3 wherein said intermediate layer is constituted of synthetic resin.

8. A projectile as claimed in claim 7 wherein said intermediate layer comprises microspheres of glass or quartz bound in said resin.

9. A projectile as claimed in claim 1 wherein said hard-core is constituted of a hard metal substance having relatively high hardness and density.

10. A projectile as claimed in claim 3 wherein said one core is constituted of a material having relatively high ductility, strength and density.

11. A projectile as claimed in claim 3 wherein said hard-core has a mass which is many times greater than that of each core spaced in front thereof.

12. A projectile as claimed in claim 3 wherein said intermediate layer and hard-core have mating surfaces, the mating surface of said hard-core being tapered and streamlined.

* * * * *